US010058166B1

(12) United States Patent
Hollinger

(10) Patent No.: US 10,058,166 B1
(45) Date of Patent: Aug. 28, 2018

(54) KEYBOARD CLEANING DEVICE AND RELATED METHODS

(71) Applicant: Christopher Hollinger, Vero Beach, FL (US)

(72) Inventor: Christopher Hollinger, Vero Beach, FL (US)

( * ) Notice: Subject to any disclaimer, the term of this patent is extended or adjusted under 35 U.S.C. 154(b) by 27 days.

(21) Appl. No.: 15/220,674

(22) Filed: Jul. 27, 2016

Related U.S. Application Data

(60) Provisional application No. 62/197,783, filed on Jul. 28, 2015.

(51) Int. Cl.

| | |
|---|---|
| ***A45D 40/00*** | (2006.01) |
| ***A46B 11/00*** | (2006.01) |
| ***A46B 9/02*** | (2006.01) |
| ***A46B 3/02*** | (2006.01) |
| ***A46B 17/04*** | (2006.01) |
| *A45D 40/26* | (2006.01) |

(52) U.S. Cl.
CPC ..... *A46B 11/0006* (2013.01); *A46B 3/02* (2013.01); *A46B 9/025* (2013.01); *A46B 11/0075* (2013.01); *A46B 17/04* (2013.01); *A45D 40/265* (2013.01)

(58) Field of Classification Search
CPC ..... A45D 40/265
USPC ..... 401/126, 129, 132, 133, 134
See application file for complete search history.

(56) References Cited

U.S. PATENT DOCUMENTS

| | | | | |
|---|---|---|---|---|
| D203,742 | S | 2/1966 | Roberts | |
| 3,447,181 | A | 6/1969 | Coker et al. | |
| 4,480,351 | A | 11/1984 | Koffler | |
| D287,430 | S | 12/1986 | Kaufman | |
| 4,712,936 | A * | 12/1987 | Kessler | A45D 40/265 300/21 |
| 4,730,949 | A | 3/1988 | Wilson | |
| 4,864,677 | A | 9/1989 | Levy | |
| 4,903,365 | A | 2/1990 | Kaufman | |
| 4,975,999 | A | 12/1990 | Levy | |
| 5,664,278 | A | 9/1997 | Reisman | |
| 6,042,287 | A | 3/2000 | Kaufman | |
| 6,854,153 | B1 | 2/2005 | Mueller | |
| 6,964,941 | B2 | 11/2005 | Argentieri et al. | |
| 7,260,863 | B2 | 8/2007 | Kaufman et al. | |
| 7,284,293 | B1 | 10/2007 | Holder et al. | |
| 7,454,813 | B2 | 11/2008 | Kaltenegger et al. | |
| 8,146,606 | B2 * | 4/2012 | Schatteman | A45D 19/02 132/208 |
| 2003/0156884 | A1 | 8/2003 | Teh | |
| 2008/0163894 | A1 | 7/2008 | Henderson | |
| 2009/0142125 | A1 * | 6/2009 | Henrikson | A45D 34/045 401/129 |

* cited by examiner

*Primary Examiner* — David Walczak
*Assistant Examiner* — Joshua Wiljanen
(74) *Attorney, Agent, or Firm* — Allen Dyer Doppelt & Gilchrist

(57) ABSTRACT

A cleaning device comprises a base having a body and a handle attached to a top surface of the body. A plurality of bristles extends from a bottom surface of the body. The cleaning device further comprises a cover having a lower section defining a reservoir for containing a predefined volume of disinfectant and an upper section defining a space for enclosing the plurality of bristles of the body. The cover is adapted to selectively cover and uncover the plurality of bristles on the base.

19 Claims, 3 Drawing Sheets

KEYBOARD CLEANING DEVICE AND RELATED METHODS

CROSS-REFERENCE TO RELATED APPLICATION

This application claims the benefit of U.S. Provisional Patent Application Ser. No. 62/197,783, filed on Jul. 28, 2015, the contents of which are herein incorporated by reference in their entirety.

FIELD OF THE INVENTION

The present invention relates to a cleaning device, and more particularly, to a cleaning device for a computer keyboard.

BACKGROUND OF THE INVENTION

Mechanical or electro-mechanical devices with keys or buttons, such as computer keyboards, calculators, cash registers and typewriter keyboards, have narrow spaces between the buttons or keys that often accumulate dust particles. Current cleaning methods include brushing, wiping with a pre-moistened towelette, or vacuuming to remove dust particles between the grooves and crevices of a keyboard or other complex surface. These cleaning methods, however, can be difficult, ineffective and time consuming. Various cleaning devices have been created for cleaning computer keyboards, but further improvements are possible, particularly if cleaning will require disinfecting a sensitive electronic keyboard or device.

SUMMARY OF THE INVENTION

In view of the foregoing, it is an object of the present invention to provide an improved device for cleaning keyboards and related methods of manufacture and use. According to one embodiment of the present invention, a cleaning device comprises a base having a body and a handle attached to a top surface of the body. A plurality of bristles extends from a bottom surface of the body. The cleaning device further comprises a cover having a lower section defining a reservoir for containing a predefined volume of disinfectant and an upper section defining a space for enclosing the plurality of bristles of the body. The cover is adapted to selectively cover and uncover the plurality of bristles on the base.

These and other objects, aspects and advantages of the present invention will be better understood in view of the drawing and following detailed description of preferred embodiments.

DETAILED DESCRIPTION OF PREFERRED EMBODIMENTS

Figure 1:
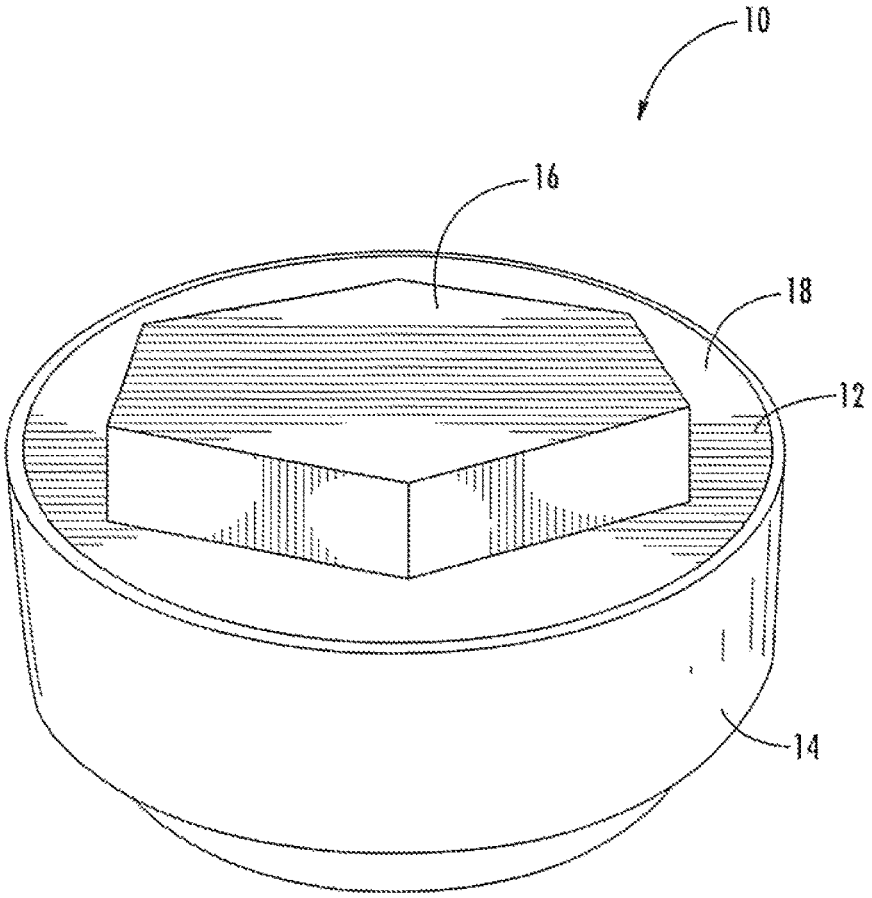
FIG. 1 is a perspective view of a base attached to a cover of a cleaning device, according to an embodiment of the presented invention.
Figure 2:
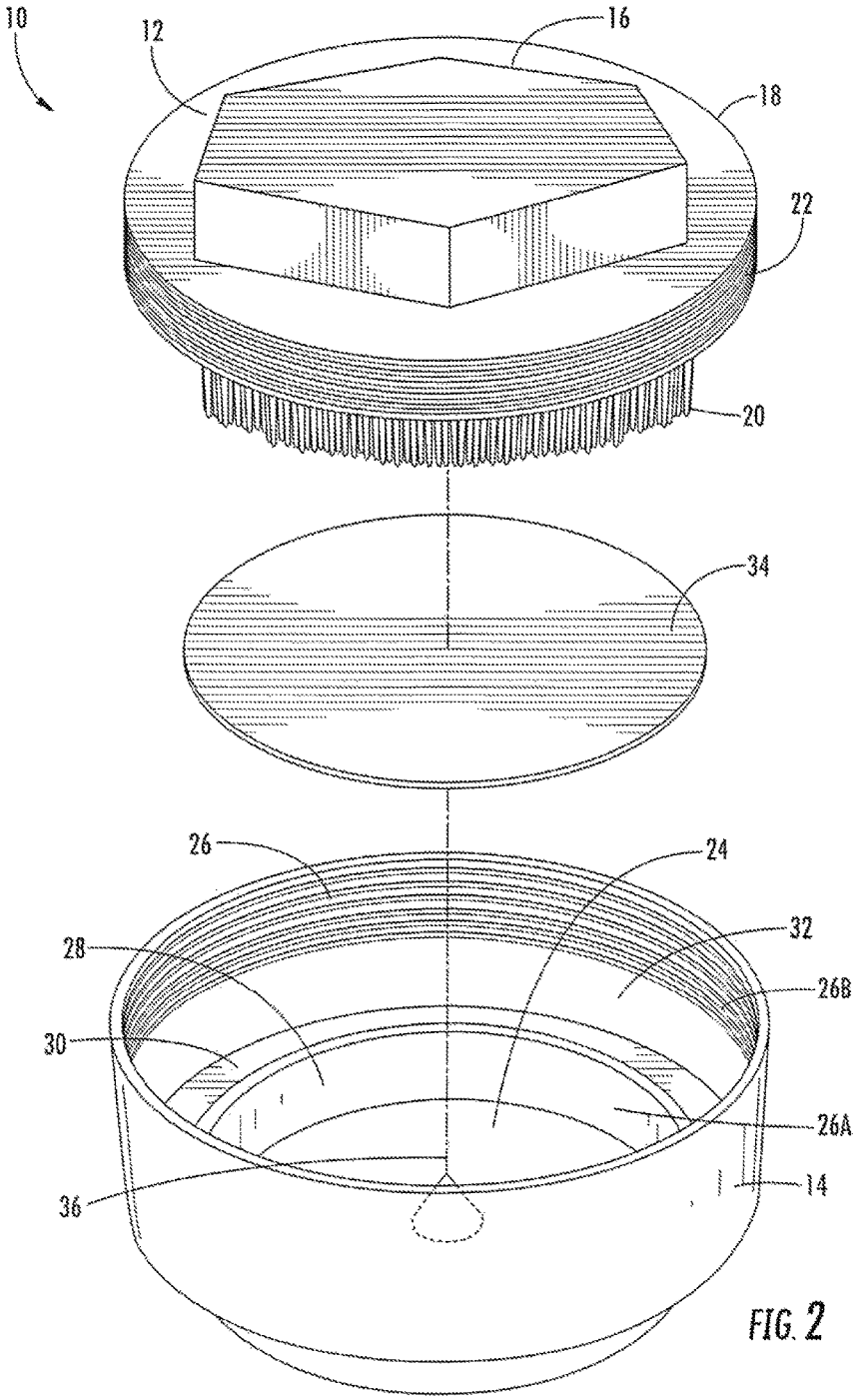
FIG. 2 is an exploded view of the base and cover of the cleaning device of FIG. 1.
Figure 3:
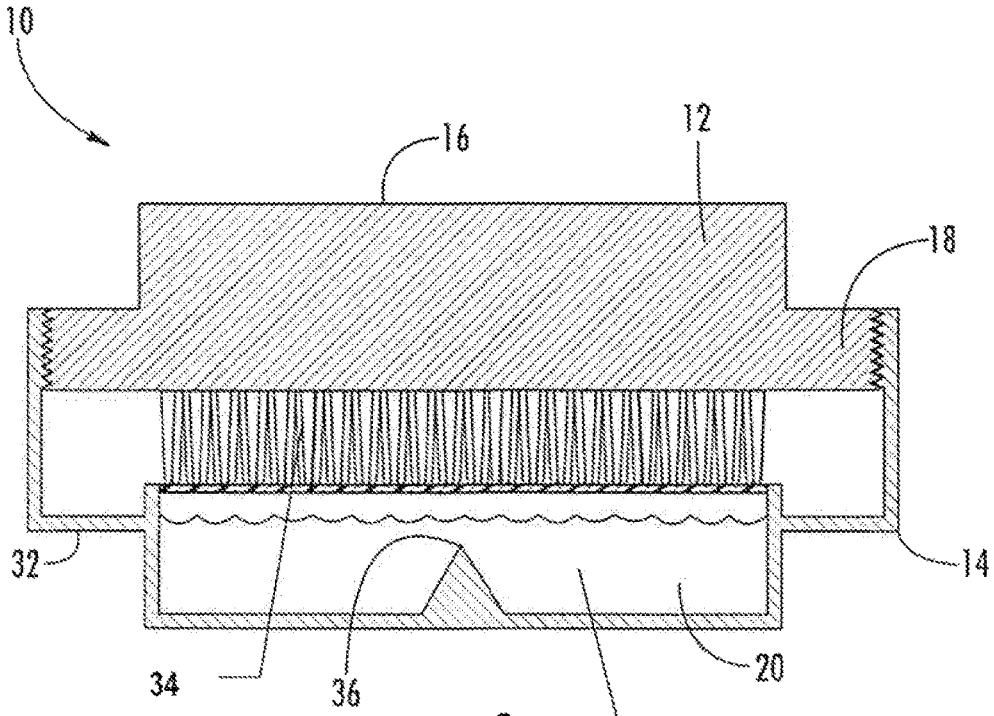
FIG. 3 is a cross sectional view the cleaning device of FIG. 1.

Referring to FIGS. 1-3, according to an embodiment of the present invention, the cleaning device 10 includes a base

12 and a cover 14. The cover 14 is repositionable relative the base 12, being able to adopt an open or a closed position for the selective uncovering or covering a plurality of bristles 20 on the base 12.

Referring to FIG. 2, the base 12 includes a handle 16 connected to a body 18. The plurality of bristles 20 extend from the bottom surface of the body 18 and they can be perpendicular to the horizontal plane of the body 18 and have a similar length, as depicted. Alternatively, the plurality of bristles 20 can be oriented in one or more angles and/or differing lengths to accommodate special circumstances or achieve certain types of cleaning goal. The plurality of bristles 20 can be connected to the body 18 via adhesive, tape, or other attachment means, or can be formed integrally therewith. The handle 16 and/or the body 18 can be circular or polygonal in shape. In one embodiment, the body 18 is a horizontal member that includes at least one sidewall 22 having a plurality of threads and/or grooves on its outer surface for connecting to the cover 14.

The cover 14 includes a bottom member 24 that extends upwards and transitions into at least one sidewall 26. In the depicted embodiment, the sidewall 26 is circular and the inner surface of the sidewall 26 can include a complementary plurality of threads and/or grooves for mating with the plurality of threads and/or grooves on the outer surface of sidewall 22. The sidewall 26 is dimensioned to be slightly larger than the sidewall 22, so that it lies closely adjacent to, and outside of, the sidewall 22 when the cover 14 is closed. The sidewall 26 defines two sections in the cover 14. A lower section 28 defines a reservoir formed by the bottom member 24 and a lower sidewall 26A for containing a predefined volume of disinfectant. An upper section 30 is formed by an upper sidewall 26B, which defines a space for fully enclosing the plurality of bristles 20. A sealing surface 32 is formed between the lower section 28 and the upper section 30 for attaching a frangible barrier 34, such as a foil or plastic membrane (not shown) for providing a fluid tight seal between the reservoir in the lower section 28 and the upper section 30. A piercing element 36 positioned in the center of the lower section 28 is adapted to pierce the frangible barrier, allowing the disinfectant stored in the lower section 28 to be exposed to the plurality of bristles 20 immediately prior to use.

Referring to FIGS. 1 and 3, to employ the cleaning device, a user applies an external pressure to the bottom member 24 of the cover 14 in the direction of the base 12. This enables the piercing element 36 to breach the frangible barrier that seals a predetermined amount of disinfectant fluid in a reservoir within the lower section 28 and allows the disinfectant to be dispensed directly to the plurality of bristles 20. The cover 14 is then removed, and the moistened plurality of bristles 20 can be used for a cleaning task with a side-to-side and/or circular motion. Following use, the soiled plurality of bristles 20 can be placed within the cover 14, preventing the contamination of the user's hands or other work surfaces and sealing in any remaining disinfectant. The soiled cleaning device can also be reused by replacing or disinfecting the soiled bristles 20, refilling the disinfectant fluid in the reservoir of the lower section 28 and replacing the pieced membrane between the lower section 28 and the upper section 30. Alternatively, the soiled cleaning device can be disposed of.

The size of the various parts of the cleaning device 10 can be varied to suit the size and shape of a given cleaning task. For example, the cleaning device may be formed into various sizes and shapes to better fit with a given size or shape of equipment or surface (e.g., keyboard surface) to be cleaned, or a various sized fluid reservoir to accommodate the calibrated volume required for a cleaning device shape and specific type of cleaning task.

The cleaning device 10 can be made of one or more materials having suitable properties for a desired application, including strength, weight, rigidity, etc. Polymeric materials are generally preferred. For example, polyethylene, polypropylene, polystyrene, thermoplastic polyester, polycarbonate, polyurethane, high density linear polyethylene, polyvinyl chloride (PVC), polyethylene terephthalate (PET), amorphous polyethylene terephthalate (APET), high density polyethylene/ethylvinyl acetate (HDPE/EVA) copolymer, glycol-modified polyethylene terephthalate (PETG), acrylonitrile butadiene styrene (ABS), cellulose acetate, and the like, can be used. In an advantageous embodiment, the base 12 and cover 14 are each formed as unitary pieces; for example by molding or stamping from a single piece of polymeric material.

In one embodiment, pictures and/or text may be printed on, embossed in, or otherwise attached to interior or exterior surfaces of the base 12 and cover 14. The pictures and/or text can be associated with descriptions of the cleaning device.

The cleaning device 10 is designed to clean all surfaces of sensitive electronic parts such as, but not limited to, keyboards, keypads, telephones, and television remotes where excessive moisture could cause dysfunction or damage. Any combination of the features, elements or components disclosed herein can be combined to form a cleaning device having features of the present invention and are considered within the scope of the present invention.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

What is claimed is:

1. A cleaning device comprises:

a base having a body and a handle attached to a top surface of an outer surface of the body, the body comprises a plurality of bristles extending from a bottom surface thereof; and a cover having a lower section defining a reservoir for containing a predefined volume of disinfectant and an upper section defining a space for enclosing the plurality of bristles of the body, and the cover is adapted to selectively cover and uncover the plurality of bristles on the base;

wherein the plurality of bristles are perpendicular to the bottom surface of the body and extend therefrom toward a barrier membrane formed between the lower section and the upper section of the cover; and wherein the cover is configured to allow disinfectant stored in the lower section to be exposed to the plurality of bristles upon receiving an external pressure to the cover.

2. The cleaning device of claim 1, further comprising a fluid tight barrier membrane attached to a sealing surface formed between the lower section and the upper section to seal disinfectant in the lower section.

3. The cleaning device of claim 2, wherein the barrier membrane is a foil or plastic membrane.

4. The cleaning device of claim 3, further comprising a piercing element positioned on a bottom surface of the lower section, wherein the piercing element is adapted to pierce the barrier membrane, allowing the disinfectant stored in the lower section to be exposed to the plurality of bristles.

5. The cleaning device of claim 1, wherein the plurality of bristles are oriented in one or more angles.

6. The cleaning device of claim 1, wherein the plurality of bristles are connected to the body via adhesive, tape or a combination thereof.

7. The cleaning device of claim 1, wherein the plurality of bristles are formed integrally therewith the body.

8. The cleaning device of claim 1, wherein the body is circular in shape.

9. The cleaning device of claim 1, wherein the body is polygonal in shape.

10. The cleaning device of claim 1, wherein the outer surface of the body includes at least one sidewall having a plurality of threads, and the cover has at least one sidewall with an inner surface having a complementary plurality of grooves for matching with the plurality of threads on the outer surface of the at least one sidewall of the body.

11. The cleaning device of claim 1, wherein outer surface of the body includes at least one sidewall having a plurality of grooves, and the cover has at least one sidewall with an inner surface having a complementary plurality of threads for matching with the plurality of grooves on the outer surface of the at least one sidewall of the body.

12. The cleaning device of claim 1, wherein the body comprises at least one of picture and text on bottom or top surfaces thereof.

13. The cleaning device of claim 1, wherein the body, the handle, and the cover are made of plastic material.

14. A cleaning device comprising:

a base having a body and a handle attached to a top surface of the body, the body has a plurality of bristles extending from a bottom surface thereof; and a cover having a lower section defining a reservoir for containing a predefined volume of disinfectant and an upper section defining a space for enclosing the plurality of bristles, and wherein the cover is adapted to selectively cover and uncover the plurality of bristles on the body; and wherein a sealing surface is formed between the lower section and the upper section for attaching a barrier membrane for providing a fluid tight seal between the reservoir in the lower section and the upper section; and wherein a piercing element is positioned on a bottom surface of the lower section, the piecing element is adapted to pierce the barrier membrane, allowing the disinfectant stored in the lower section to be exposed to the plurality of bristles.

15. The cleaning device of claim 14, wherein outer surface of body comprise at least one sidewall having a plurality of threads, and the cover has at least one sidewall with an inner surface having a complementary plurality of grooves for matching with a plurality of threads on the outer surface of sidewall of the body.

16. The cleaning device of claim 14, wherein outer surface of body includes at least one sidewall having a plurality of grooves, and the cover has at least one sidewall with an inner surface having a complementary plurality of threads for matching with a plurality of grooves on the outer surface of sidewall of the body.

17. The cleaning device of claim 14, wherein the plurality of bristles are perpendicular to the bottom surface of the body.

18. The cleaning device of claim 14, wherein the plurality of bristles are oriented in one or more angles.

19. The cleaning device of claim 14, wherein the plurality of bristles are connected to the body via adhesive, tape or a combination thereof.

* * * * *